United States Patent [19]

Sekiya

[11] 4,278,583

[45] Jul. 14, 1981

[54] PAPER COATING COMPOSITION

[75] Inventor: Masayoshi Sekiya, Tokyo, Japan

[73] Assignee: Nippon Zeon Co. Ltd., Tokyo, Japan

[21] Appl. No.: 105,608

[22] Filed: Dec. 20, 1979

Related U.S. Application Data

[63] Continuation of Ser. No. 929,914, Aug. 1, 1978, abandoned.

[30] Foreign Application Priority Data

Aug. 10, 1977 [JP] Japan ..... 52/95932

[51] Int. Cl.[3] ..... C08L 33/02

[52] U.S. Cl. ..... 260/29.7 H; 428/511

[58] Field of Search ..... 260/29.7 H, 29.7 T; 428/511

[56] References Cited

U.S. PATENT DOCUMENTS

| | | | |
|---|---|---|---|
| 3,957,710 | 5/1976 | Rohmann | 260/29.7 T |
| 3,970,629 | 7/1976 | Izaki | 260/29.7 T |

*Primary Examiner*—Paul R. Michl

*Attorney, Agent, or Firm*—Sherman & Shalloway

[57] ABSTRACT

A paper coating composition having improved ink receptivity in multi-color printing which comprises (I) 100 parts by weight of a pigment, and (II) 1 to 30 parts by weight, as solids content, of a latex of a copolymer derived from 20 to 50% by weight of an aliphatic conjugated diolefin, 0.5 to 5% by weight of an ethylenically unsaturated acid monomer, 0.5 to 5% by weight of an ethylenically unsaturated amine monomer, and 10 to 74% by weight of a monoolefinically unsaturated monomer, said latex containing not more than 1% by weight, based on the copolymer of an emulsifier, having a gel point within a pH range of 3.5 to 8.5 and being gellable during the drying of a paper coated with said composition, said composition having a higher pH than the gel point of the latex.

11 Claims, No Drawings

PAPER COATING COMPOSITION

This is a continuation of application Ser. No. 929,914, filed Aug. 1, 1978, now abandoned.

This invention relates to a paper coating composition, and more specifically, to a paper coating composition which can improve ink receptivity in multi-color printing.

Large quantities of coated papers and coated paperboards have been produced and used in recent years for publishing and packaging purposes. The main purpose of paper coating in either case is to increase the effect of printing and the market value of printed or packaged goods. The printing process can be roughly classified into relief printing, lithography (offset printing) and intaglio printing (gravure printing). The lithographic process is by far the most prevalent method, and its acceptance has especially increased in recent years as a result of the widespread use of a web offset printing process. Coated papers and coated paperboards for offset printing have been extensively studied over many years in regard to base papers, coating compositions and coating devices, and resulted in the solution of various problems associated with the printing operation and printed matter. One great problem which still remains unsolved is the receptivity of ink in multi-color printing.

The ink receptivity in multi-color printing by the offset process represents the degree of transfer of inks of second and subsequent colors from the printing roll to paper. In coated papers or paperboards having poor ink receptivity, transfer of inks of the second and subsequent colors is insufficient. Accordingly, the desired printing result cannot be obtained, and the market value of the printed matter decreases greatly. It is known that the water absorptivity of paper greatly affects the receptivity of inks of the second and subsequent colors in multi-color printing by the offset process (to be referred to simply as ink receptivity). Specifically, with paper having poor water absorptivity, the water used in printing a first color remains on the paper surface, and affects the transfer of inks of second and subsequent colors.

Synthetic latices, especially a carboxyl-modified styrene/butadiene copolymer latex, are generally used as a primary binder for coated papers for printing, especially offset printing. Conventional coated papers produced by using the carboxyl-modified styrene/butadiene copolymer latex have many superior properties in regard to dry pick strength, wet pick strength, gloss and printed gloss. When the coating of the latex on paper is carried out using a paper coating composition of a low concentration and a low viscosity or the drying of the resultant coating is carried out at a high temperature for a short period of time, the resulting coated paper has only insufficient water absorptivity. This often leads to a trouble of poor ink transfer, and the use of this latex constitutes a great setback against the increase of the coating speed intended for improving the efficiency of coating.

Means so far suggested for increasing the ink receptivity of coated papers include, for example, (1) the minimization of the proportion of the primary binder, (2) increasing of the interspaces among the pigment particles by using non-platelike pigment particles, and (3) use of a pigment or binder having strong hydrophilicity. Coated papers for offset printing are currently produced by using these means either alone or in combination, but none of these means are entirely satisfactory.

It is an object of this invention therefore to improve these prior art techniques, and to provide a composition suitable for coating papers for offset printing.

This object can be achieved in accordance with this invention by a paper coating composition comprising (I) 100 parts by weight of a pigment, and (II) 1 to 30 parts by weight, as solids content, of a latex of a copolymer derived from 20 to 50% by weight of an aliphatic conjugated diolefin, 0.5 to 5% by weight of an ethylenically unsaturated acid monomer, 0.5 to 5% by weight of an ethylenically unsaturated amine monomer, and 10 to 74% by weight of a mono-olefinically unsaturated monomer, said latex containing not more than 1% by weight, based on the copolymer, of an emulsifier, having a gel point within a pH range of 3.5 to 8.5 and being gellable during the drying of a paper coated with said composition, said composition having a higher pH than the gel point of the latex.

The increase of ink receptivity by the use of the paper coating composition of this invention containing an amphoteric copolymer latex is ascribable to the fact that the amphoteric copolymer latex in the composition is gelled during the coating of the composition on paper and drying the coating, and consequently, the migration of the copolymer latex as a primary binder to the surface of the coating is prevented. It is therefore the most important requirement of the invention that the amphoteric copolymer latex in the coating composition should have a gel point within the aforesaid range. U.S. Pat. No. 3,404,114, for example, discloses the emulsion polymerization of (A) from about 1 to about 25% of an ethylenically unsaturated carboxylic monomer such as methacrylic acid or acrylic acid, (B) about 50 to about 98% of at least one monovinylidene monomer such as methyl acrylate, ethyl acrylate, methyl methacrylate or styrene, and (C) about 1 to about 25% of an alkylaminoalkyl ester of an $\alpha,\beta$-ethylenically unsaturated carboxylic acid monomer such as tertiary butylaminoethyl methacrylate or dimethylaminoethyl methacrylate. The purpose of this process is to improve freeze stability by using a large amount of an emulsifier. Hence, the resulting copolymer latex does not have a gel point within the range specified in the present invention, and the use of this copolymer latex as a binder for paper coating cannot produce the effect intended by the present invention.

U.S. Pat. No. 3,957,710 discloses a paper coating composition comprising a latex of an amphoteric copolymer derived from (a) 5 to 30% by weight of a mono-olefinically unsaturated carboxylic acid such as acrylic acid, (b) 5 to 30% by weight of a mono-olefinically unsaturated monomer containing basic nitrogen atoms such as N-dimethylaminoethyl acrylate, and (c) 50 to 80% by weight of a $C_{4-8}$ mono-olefinically unsaturated carboxylate such as ethyl acrylate, or styrene. This copolymer latex is used not as a primary binder, but as a substitute for another binder material such as casein to be used together with a primary binder. The purpose of using this copolymer latex is to improve the brightness of a coated paper containing an optical brightener. Since this copolymer latex is used together with another synthetic latex that acts as a primary binder, a large amount of emulsifier is contained in the composition. Thus, the copolymer latex does not have a gel point within the range specified by the present invention, and the effect of the invention cannot be obtained.

The copolymer latex (II) used in the present invention is produced by known emulsion-polymerization techniques. To prevent the formation of a coagulum during the polymerization, it should be produced preferably under conditions such that the ethylenically unsaturated acid monomer and the ethylenically unsaturated amine monomer are not present simultaneously in the polymerization system. To achieve this end, a latex consisting of the aliphatic conjugated diolefin, the ethylenically unsaturated acid monomer and the mono-olefinically unsaturated monomer is produced by a known emulsion-polymerization technique in a first step. After the reaction, as a second step, the ethylenically unsaturated amine alone or together with the aliphatic conjugated diolefin and the mono-olefinically unsaturated monomer, is added, and the reaction is continued until it is completed. Favorable results are obtained by adding an alkali for adjusting the pH of the reaction system to at least 7, preferably at least 9, after the end of the first step. In the present invention, anionic surface-active agents, nonionic surface-active agents and amphoteric surface-active agents, either alone or as mixtures, are used as emulsifiers in latex preparation. When a large amount of an emulsifier is used, a trouble of bubbling occurs during the coating of the composition on paper, and it is difficult to maintain wet pick strength required of a coated paper for offset printing. The amount of the emulsifier should therefore be not more than 1% by weight, preferably not more than 0.5% by weight, based on the copolymer.

The aliphatic conjugated diolefin imparts flexibility required of a primary binder. When the proportion of this monomeric unit in the copolymer is less than 20% by weight, the resulting copolymer becomes too hard, and its pigment binding power decreases. When it exceeds 50% by weight, the resulting coated paper has reduced wet pick strength, and is undesirable for use in offset printing. Examples of the aliphatic conjugated diolefin used in this invention are 1,3-butadiene, 2-methyl-1,3-butadiene and 2-chloro-1,3-butadiene.

The ethylenically unsaturated acid monomer is an essential ingredient for increasing the adhesion among pigment particles and the adhesion of the pigment to paper, improving the stability of the copolymer latex as a colloid, and in combination with the ethylenically unsaturated amine, adjusting the gel point of the latex. The amount of this monomer in the copolymer is 0.5 to 5% by weight, preferably 1 to 5% by weight. When the amount of the monomeric unit in the copolymer is less than 0.5% by weight, it is difficult to achieve the intended object. When it exceeds 5% by weight, it is difficult to impart a gel point within the range specified in the present invention. Examples of the ethylenically unsaturated acid monomer include unsaturated carboxylic acids such as acrylic acid, methacrylic acid, crotonic acid, cinnamic acid, itaconic acid, fumaric acid, maleic acid and butenetricarboxylic acid; monoalkyl esters of unsaturated dicarboxylic acids such as monoethyl itaconate, monobutyl fumarate and monobutyl maleate; and unsaturated sulfonic acids or their alkali metal salts such as sodium sulfoethyl acrylate, sodium sulfopropyl methacrylate and acrylamide propanesulfonic acid.

The ethylenically unsaturated amine monomer is an essential ingredient for imparting a gel point to the latex and achieving the object of the present invention. The proportion of this monomeric unit in the copolymer is 0.5 to 5% by weight, preferably 1 to 5% by weight. When the amount is less than 0.5% by weight, it is difficult to achieve the object of the invention. When the amount exceeds 5% by weight, it is difficult to impart a gel point within the range specified in the present invention. Moreover, a trouble such as the occurrence of a coagulum at the time of producing the copolymer latex arises. Examples of the ethylenically unsaturated amine monomer used in this invention include (a) monomers expressed by the general formula

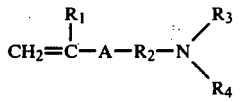

Wherein $R_1$ represents hydrogen or methyl, $R_2$ represents alkylene of 2 to 10 carbon atoms, $R_3$ and $R_4$ represents hydrogen or alkyl of 2 to 12 carbon atoms, and A represents

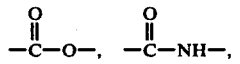

or —O—, for example aminoalkyl esters of ethylenically unsaturated carboxylic acids such as methylaminoethyl (meth)acrylate, t-butylaminoethyl (meth)acrylate, dimethylaminoethyl (meth)acrylae, dimethylaminopropyl (meth)acrylate, diethylaminoethyl (meth)acrylate and dibutylaminoethyl (meth)acrylate; aminoalkylamides of ethylenically unsaturated carboxylic acids such as methylaminoethyl (meth)acrylamide, dimethylaminoethyl (meth)acrylamide and dimethylaminopropyl (meth)acrylamide; and aminoalkyl vinyl ethers such as aminoethylvinyl ether, methylaminoethylvinyl ether and diemthylaminoethylvinyl ether; and (b) vinylpyridines such as 2-vinylpyridine, 4-vinylpyridine, 2-methyl-5-vinylpyridine and 2,4-diethyl-5-vinylpyridine.

The mono-olefinically unsaturated monomer used in this invention is effective for giving not only moderate hardness but also wet pick strength to the resulting copolymer. The proportion of the monomer in the copolymer is 10 to 74% by weight. When the amount is less than 10% by weight, it is impossible to afford a copolymer having the aforesaid properties. When it exceeds 74% by weight, the film-forming property of the copolymer decreases, and the adhesion strength is reduced. Examples of the mono-olefinically unsaturated monomer include aromatic vinyl compounds such as styrene, α-methylstyrene, monochlorostyrene and vinyltoluene; alkyl acrylates or methacrylates such as methyl acrylate, methyl methacrylate, ethyl acrylate and butyl acrylate; and ethylenic nitrile compounds such as acrylonitrile and methacrylonitrile. If desired, a hydrophilic monomer such as β-hydroxyethyl acrylate, β-hydroxypropyl acrylate, β-hydroxyethyl acrylate, acrylamide, methacrylamide, N-methylol acrylamide, diacetone acrylamide, glycidyl acrylate, glycidyl methacrylate, acrolein, and allyl alcohol can be used together with the aforesaid mono-olefinically unsaturated monomer.

The copolymer latex used in this invention should have a gel point within a pH range of 3.5 to 8.5. When the gel point of the latex is at a pH of less than 3.5, no effect of improving the ink receptivity can be produced. When the gel point is at more than pH 8.5, the other properties required of a coated paper for offset printing, such as wet pick strength and dry pick strength, will be degraded.

In the present application, the gel point is measured as follows:

(1) Prepare various Michaelis buffer solutions.

(2) Take about 10 ml of each buffer solution into a transparent container having an inner capacity of 60 ml.

(3) Add one drop (about 0.1 g) of a sample latex having a solids concentration of 40%, and mix them well.

(4) Allow the mixture to stand in a constant-temperature chamber at 25° C. for about 30 minutes, again mix them well, and observe the mixture for the occurrence of a coagulum.

The above test is carried out successively starting with a buffer solution having the highest pH and then on those having a decreasing pH. The pH of the buffer solution in which a coagulum occurs for the first time is defined as the gel point of the latex.

Adjustment of the gel point can be performed by any desired method. It can be especially conveniently carried out by properly choosing the type and amount of the ethylenically unsaturated acid monomer, or the type and amount of the ethylenically unsaturated amine monomer. The type and amount of the emulsifier, the type and amount of the initiator, and the type and amount of the hydrophilic monomer also affect the gel point of the copolymer latex. In particular, the type and amount of the emulsifier are important. When the amount of the emulsifier is large, it is difficult to adjust the gel point of the latex to the range specified in this invention. In particular, when a nonionic emulsifier is used in an amount of more than 1% by weight based on the copolymer, the latex has no gel point even if it has a composition within the range specified in the present invention. Such a latex is not suitable for the object of this invention.

The pigment (I) used in this invention includes, for example, inorganic pigments such as clay, calcium carbonate, aluminum hydroxide, titanium white, barium sulfate, satin white and talc; and organic pigments such as polystyrene and phenolic resins. These pigments are used either alone or as mixtures. In order to produce the effect of the invention greatly, it is preferred that at least 50% by weight of the pigment should be composed of clay, especially kaolinite clay.

The copolymer latex (II) as a binder is used in an amount of 1 to 30 parts by weight (as solids) per 100 parts by weight of the pigment. If required, starch, casein, polyvinyl alcohol, etc. may be used together with the copolymer latex of the present invention. It is also possible to use latices known as binders for paper coating compositions, such as a styrene/butadiene copolymer latex, a methyl methacrylate/butadiene copolymer latex, or a polyvinyl acetate latex, in conjunction with the aforesaid binders.

Furthermore, the composition of the invention may further contain other additives such as pigment dispersants, viscosity controlling agents, water retaining agents, water-proofing agents, dyes, fluorescent dyes, lubricants, pH adjusting agents, antifoamers, surface active agents and preservatives in addition to water, the pigment and the binder.

The composition of this invention should be maintained at a higher pH than the gel point of the copolymer latex. When its pH is below the gel point of the latex, the effect of improving ink receptivity decreases. Ammonia solution is preferred as a pH adjuster. When the paper coating composition of the invention is coated on paper and dried, ammonia volatilizes, and consequently the pH of the composition is lowered to a pH corresponding to the gel point of the copolymer latex, whereupon the copolymer latex gels. For this reason, migration of the latex to the surface of the coating is prevented, and the effect intended by the invention is produced.

The following Examples illustrate the present invention more specifically. It should be noted however that the invention is not limited to these Examples. All parts and percentages in the examples are by weight.

EXAMPLE 1

A tank equipped with a stirrer was charged with the following ingredients, and a monomer emulsion was prepared by stirring them.

| Ingredient | Amount (parts) |
|---|---|
| Water | 48 |
| Sodium laurylsulfate | 0.2 |
| Sodium bicarbonate | 0.5 |
| Styrene | 59.1 |
| Butadiene | 36.5 |
| Methacrylic acid | 2.4 |
| Carbon tetrachloride | 3.0 |

An autoclave equipped with a stirrer was charged with 32 parts of water, 0.1 part of tetrasodium ethylenediamine-tetraacetate, 0.1 part of sodium laurylsulfate and 0.2 part of potassium persulfate, and further 10% of the monomer emulsion was added. The mixture was heated to 80° C. with stirring, and reacted for 1 hour. Then, 0.8 part of potassium persulfate and 20 parts of water were charged into the autoclave, and the remainder of the monomer emulsion was continuously fed into the autoclave over the course of 4 hours. During this time, the contents of the autoclave were maintained at 80° C. The contents were further maintained at 80° C. for 1 hour, and the unreacted monomers were removed from the contents of the autoclave by steam distillation. Ammonia solution was added to the resulting latex to adjust its pH to 9.0. Then, 4.0 parts of water, 2.0 parts of dimethylaminoethyl methacrylate and 0.1 part of ammonium persulfate were added to the latex, and the reaction was performed at 80° C. for 2 hours. The resulting copolymer latex is designated as latex A.

For comparison, the gel points of latex A and commercial paper coating latices, i.e. styrene/butadiene copolymer latices (I to VII), a methyl methacrylate/butadiene copolymer latex and a polyvinyl acetate latex were measured. The results are shown in Table 1. It is seen that the commercial latices either do not have a gel point, or have a gel point of 1.4 (the lower limit of the Michaelis buffer solution) or below.

TABLE 1

| | Latex | Gel point |
|---|---|---|
| | Latex A | 7.2 |
| | Commercial latices | |
| (a) | Carboxyl-modified styrene/butadiene copolymer latex I | No (*) |
| (b) | Carboxyl-modified styrene/butadiene copolymer latex II | " |
| (c) | Carboxyl-modified styrene/butadiene copolymer latex III | " |
| (d) | Carboxyl-modified styrene/butadiene copolymer latex IV | " |
| (e) | Carboxyl-modified styrene/butadiene copolymer latex V | " |

TABLE 1-continued

| Latex | Gel point |
|---|---|
| (f) Carboxyl-modified styrene/ butadiene copolymer latex VI | " |
| (g) Carboxyl-modified styrene/ butadiene copolymer latex VII | " |
| (h) Methyl methacrylate/butadiene copolymer latex | " |
| (i) Polyvinyl acetate latex | " |

(*) This indicates that there is no gel point, or the gel point is 1.4 or below.

A paper coating composition was prepared in accordance with formulation 1 below using each of latex A and the commercial latices.

| Formulation | |
|---|---|
| Ingredient | Amount (parts) |
| Kaolinite clay (1) | 100 |
| Dispersant (2) | 0.15 |
| Viscosity controlling agent (3) | 0.3 |
| Ammonia solution (28%) | 0.11 |
| Latex (as solids) | 18 |

Note
(1) Hydrafine, a product of J. M. Huber Company.
(2) Aron T-40, a product of Toa Gosei K.K.
(3) Kelgin, a product of Kelco Company.

Ammonia solution was additionally supplied whenever required to adjust the solids concentration to 43% and the pH of the composition to 8.7.

The resulting composition was coated on a base paper by an applicator bar so that the amount of the coating composition on one surface became 16±1 g/m². Immediately after application, the coating was dried in hot air at 130° C. for 30 seconds. The resulting coated paper was conditioned overnight in a chamber kept at 20° C. and RH 65%, and subjected twice to supercalender treatment at a temperature of 60° C. and a linear pressure of 100 kg/cm. The product was tested for the properties shown in Table 2, and the results are shown in Table 2.

TABLE 2

| Latex | Ink receptivity (*1) | Gloss (%) (*2) | Printed gloss (%) (*3) | Brightness (%) (*4) | Dry pick strength (*5) | Wet pick strength (*6) |
|---|---|---|---|---|---|---|
| A | 5.0 | 66.0 | 85.7 | 77.2 | 4.0 | 3.8 |
| (a) | 1.5 | 65.5 | 86.0 | 75.1 | 4.8 | 4.8 |
| (b) | 1.5 | 65.9 | 86.6 | 75.5 | 4.8 | 4.8 |
| (c) | 1.0 | 62.1 | 84.8 | 74.8 | 4.8 | 4.5 |
| (d) | 1.5 | 64.3 | 85.6 | 75.8 | 3.5 | 4.5 |
| (e) | 1.0 | 64.4 | 84.9 | 74.9 | 4.8 | 3.5 |
| (f) | 1.5 | 65.5 | 85.1 | 75.1 | 3.3 | 4.8 |
| (g) | 1.5 | 63.0 | 85.5 | 75.1 | 4.0 | 3.5 |
| (h) | 2.0 | 65.5 | 86.5 | 75.2 | 3.8 | 2.8 |

TABLE 2-continued

| Latex | Ink receptivity (*1) | Gloss (%) (*2) | Printed gloss (%) (*3) | Brightness (%) (*4) | Dry pick strength (*5) | Wet pick strength (*6) |
|---|---|---|---|---|---|---|
| (i) | 3.0 | 62.1 | 83.3 | 75.5 | 2.0 | 1.5 |

(*1) Using an RI tester (made by Akashi Seisakusho K.K.), solid printing with black ink for offset printing was performed on a test specimen coated with water by a Molten roll. The receptivity of the ink (the density of the ink) was observed by the naked eye, and rated on a scale of 1 to 5 in which 5 represents "excellent", and 1, "poor".
(*2) Using a gloss meter (made by Murakami Shikisai Kenkyusho), the 75-75° reflectance of the paper surface was measured.
(*3) Using an RI tester, solid printing with 0.3 ml of an offset ink was performed on the test specimen. The printed specimen was allowed to stand for one day in a chamber maintained at 20° C. and RH 65%, and then its 75-75° reflectance was measured by a gloss meter.
(*4) Measured by a gloss meter to which was attached an adapter for measurement of brightness.
(*5) Using an RI tester, printing was performed six times successively on the same test specimen. The degree of picking of the specimen was observed by the naked eye and rated on a scale of 1 to 5.
(*6) Using an RI tester, solid printing with a high tack offset ink was performed on a test specimen coated with water by a Molten roll. The degree of picking of the specimen was observed by the naked eye, and rated on a scale of 1 to 5.

EXAMPLE 2

Copolymer latices of the compositions shown in Table 3 were prepared under the same conditions as in Example 1. In the formation of latex(l) for comparison in which no unsaturated acid monomer was used, 0.6 part by weight of sodium laurylsulfate was added before the addition of dimethylaminoethyl methacrylate in order to prevent the occurrence of a coagulum during the polymerization. In comparison (m), 3.0 parts of polyoxyethylene nonylphenyl ether (30 moles of ethylene oxide) and 0.2 part of sodium laurylsulfate were used at the time of preparing a monomer emulsion. The gel points of these latices were measured, and the results are shown in Table 3.

TABLE 3

| | Latex | | | | | | | | |
|---|---|---|---|---|---|---|---|---|---|
| | Invention | | | | | Comparison | | | |
| Monomers | B | C | D | E | F | (j) | (k) | (l) | (m) |
| Butadiene | 36.5 | 36.5 | 36.5 | 36.5 | 36.5 | 36.5 | 36.5 | 36.5 | 36.5 |
| Styrene | 60.3 | 57.9 | 56.7 | 58.1 | 57.1 | 61.1 | 61.1 | 61.5 | 61.5 |
| Methacrylic acid | 1.2 | 3.6 | 4.8 | 2.4 | 2.4 | 2.4 | — | — | 3.6 |
| Itaconic acid | — | — | — | — | — | — | 2.4 | — | — |
| Dimethylaminoethyl methacrylate | 2.0 | 2.0 | 2.0 | 3.0 | 4.0 | — | — | 2.0 | 2.0 |
| Gel point | 7.7 | 6.8 | 6.2 | 7.7 | 8.4 | no | no | 8.7 | no |

Coated papers were prepared by using latices B to F and (j) to (m) in accordance with the same formulation as in Example 1 under the same coating conditions. The results of tests are shown in Table 4.

TABLE 4

| Latex | Ink receptivity | Gloss (%) | Printed gross (%) | Brightness (%) | Dry pick strength | Wet pick strength |
|---|---|---|---|---|---|---|
| B | 5.0 | 66.9 | 82.0 | 77.4 | 3.3 | 3.5 |
| C | 4.0 | 71.8 | 85.5 | 75.5 | 4.0 | 4.7 |
| D | 3.5 | 74.2 | 87.8 | 75.0 | 4.5 | 5.0 |
| E | 4.5 | 67.6 | 82.0 | 76.6 | 3.5 | 4.0 |
| F | 5 | 66.3 | 81.4 | 76.9 | 3.3 | 3.3 |
| (j) | 1.5 | 66.8 | 86.2 | 75.0 | 4.8 | 4.5 |
| (k) | 1.0 | 66.8 | 84.0 | 75.0 | 4.8 | 4.5 |
| (l) | 4.3 | 67.6 | 78.6 | 76.1 | 1.5 | 1.5 |
| (m) | 1.5 | 65.9 | 85.3 | 75.1 | 4.5 | 3.3 |

The results shown in Table 4 demonstrate that when the copolymer latices in accordance with this invention are used, coated papers having very good water absorptivity (ink receptivity) can be obtained as compared with the use of carboxyl-modified styrene/butadiene copolymer latices (comparisons (j) and (k)) having no gel point. The latex (l) having no unsaturated acid as a comonomer exhibited far inferior results to the copolymer latices of the invention in regard to pigment binding characteristics such as dry pick strength and wet pick strength.

It is also seen from Table 3 that a copolymer latex having the composition within the range of the invention but containing more than 1% by weight of the emulsifier (comparison (m)) does not have a gel point within the range specified in the invention, and a coated paper obtained by using this latex does not show improved ink receptivity.

EXAMPLE 3

Copolymer latices were prepared under the same conditions as in Example 1 except that the monomers shown in Table 5 in the amounts indicated were used. The gel points of these latices are shown in Table 5.

TABLE 5

| Latex | G | H | I | J | K | L | M | N | O |
|---|---|---|---|---|---|---|---|---|---|
| Monomer composition | | | | | | | | | |
| Butadiene | 36.5 | 36.5 | 36.5 | 36.5 | 36.5 | 36.5 | 36.5 | 36.5 | 36.5 |
| Styrene | 61.1 | 61.1 | 61.1 | 61.1 | 61.1 | 61.1 | 61.1 | 61.1 | 61.1 |
| Acrylic acid | 2.4 | — | — | — | — | — | — | — | — |
| Methacrylic acid | — | — | — | — | — | — | — | 2.4 | 2.4 |
| Itaconic acid | — | 2.4 | — | — | — | — | — | — | — |
| Maleic acid | — | — | 2.4 | — | — | — | — | — | — |
| Fumaric acid | — | — | — | 2.4 | — | — | — | — | — |
| Sodium sulfoethyl acrylate | — | — | — | — | 2.4 | — | — | — | — |
| Sodium sulfopropyl acrylate | — | — | — | — | — | 2.4 | — | — | — |
| Acrylamide propanesulfonic acid | — | — | — | — | — | — | 2.4 | — | — |
| Dimethylaminoethyl methacrylate | 2.0 | 2.0 | 2.0 | 2.0 | 2.0 | 2.0 | 2.0 | — | — |
| Diethylaminoethyl methacrylate | — | — | — | — | — | — | — | 2.0 | — |
| 2-Vinylpyridine | — | — | — | — | — | — | — | — | 2.0 |
| Gel point | 7.0 | 5.7 | 5.9 | 5.5 | 7.9 | 8.1 | 7.9 | 6.5 | 6.2 |

Coated papers were prepared by using latices G to O and the commercial latex (a) in accordance with the same formulation as in Example 1 under the same coating conditions. The results of tests are shown in Table 6.

TABLE 6

| Latex | Ink receptivity | Gloss (%) | Printed gloss (%) | Brightness (%) | Dry pick strength | Wet pick strength |
|---|---|---|---|---|---|---|
| G | 5.0 | 65.8 | 82.3 | 76.3 | 4.0 | 3.8 |

TABLE 6-continued

| Latex | Ink receptivity | Gloss (%) | Printed gloss (%) | Brightness (%) | Dry pick strength | Wet pick strength |
|---|---|---|---|---|---|---|
| H | 4.0 | 67.9 | 81.7 | 76.0 | 4.8 | 4.5 |
| I | 4.5 | 65.4 | 82.2 | 76.1 | 4.5 | 4.5 |
| J | 3.8 | 67.5 | 86.9 | 75.7 | 5.0 | 5.0 |
| K | 4.5 | 66.1 | 84.1 | 75.7 | 4.0 | 3.5 |
| L | 4.7 | 66.1 | 80.5 | 75.8 | 3.3 | 3.3 |
| M | 4.0 | 68.3 | 79.4 | 75.8 | 3.3 | 3.3 |
| N | 3.8 | 70.9 | 86.3 | 75.0 | 4.7 | 4.8 |
| O | 3.3 | 72.1 | 86.3 | 75.0 | 4.8 | 4.8 |
| (a) | 1.5 | 66.2 | 85.8 | 74.5 | 4.8 | 4.8 |

It is seen from the results shown in Table 6 that the use of the copolymer latices of this invention can afford coated papers having very good ink receptivity. The best pigment binding power represented by dry pick strength and wet pick ptrength is obtained when an ethylenically unsaturated carboxylic acid is used as the unsaturated acid monomer.

EXAMPLE 4

Latices were prepared under the same conditions as in Example 1 except that the monomer compositions shown in Table 7 were used. The gel points of these latices were measured, and the results are shown in Table 7.

TABLE 7

| | Latex | | | | | | | | |
|---|---|---|---|---|---|---|---|---|---|
| | P | Q | R | S | T | U | V | (n) | (o) |
| Monomers | Invention | | | | | | | Comparison | |
| Butadiene | 31.5 | 41.5 | 46.5 | 31.5 | 36.5 | 36.5 | 36.5 | 18 | 63 |
| Styrene | 64.1 | 54.1 | 49.1 | 49.1 | 44.1 | 44.1 | 44.1 | 77.6 | 32.6 |
| Methyl methacrylate | — | — | — | 15 | 15 | — | — | — | — |
| Methacrylic acid | 2.4 | 2.4 | 2.4 | 2.4 | 2.4 | — | — | 2.4 | 2.4 |
| Itaconic acid | — | — | — | — | — | 2.4 | 2.4 | — | — |
| β-Hydroxyethyl acrylate | — | — | — | — | — | 2.0 | — | — | — |
| Acrylamide | — | — | — | — | — | — | 2.0 | — | — |
| Diemthylaminoethyl methacrylate | 2.0 | 2.0 | 2.0 | 2.0 | 2.0 | 2.0 | 2.0 | 2.0 | 2.0 |
| Gel point | 7.0 | 6.8 | 6.7 | 6.9 | 6.7 | 5.7 | 5.0 | 7.3 | 6.6 |

Coated papers were prepared by using latices P to V and (n) and (o) in accordance with the same formulation as in Example 1 under the same conditions. The results of tests are shown in Table 8.

TABLE 8

| Latex | ink receptivity | Gloss (%) | Printed gloss (%) | Brightness (%) | Dry pick strength | Wet pick strength |
|---|---|---|---|---|---|---|
| P | 4.3 | 67.6 | 81.1 | 77.3 | 3.3 | 4.3 |
| Q | 4.5 | 67.7 | 77.2 | 77.0 | 4.0 | 3.5 |
| R | 4.5 | 68.1 | 75.5 | 76.6 | 4.5 | 3.3 |
| S | 4.5 | 67.8 | 81.5 | 77.9 | 3.3 | 4.0 |
| T | 5.0 | 68.0 | 80.9 | 77.9 | 4.0 | 3.8 |
| U | 4.0 | 70.5 | 80.5 | 76.1 | 4.8 | 4.8 |
| V | 3.8 | 68.8 | 84.4 | 76.1 | 4.8 | 4.8 |
| (n) | 4.0 | 67.2 | 81.9 | 77.3 | 1.8 | 3.0 |
| (o) | 3.5 | 68.6 | 70.2 | 76.4 | 3.5 | 2.0 |

It is evident from Table 8 that the coated papers obtained by using the copolymer latices in accordance with this invention have superior ink receptivity, good coat adhesion and good surface gloss. When the latices (n) and (o) in which the amount of butadiene was outside the scope of the invention were used, the dry pick strength or wet pick strength of the coated papers was insufficient.

EXAMPLE 5

By using latices A, H and T and commercial latex (a), coating compositions were prepared in accordance with the following formulations 2 and 3.

| ingredient | Amount (parts) |
|---|---|
| Formulation 2 | |
| Kaolinite clay (1) | 100 |
| Dispersant (2) | 0.15 |
| Ammonia solution | 0.16 |
| Oxidized starch (3) | 4 |
| Latex (as solids) | 14 |
| Solids concentration | 45% |
| pH | 8.5 |
| Formulation 3 | |
| Kaolinite clay (1) | 100 |
| Dispersant (2) | 0.15 |
| Ammonia solution | 0.16 |
| Polyvinyl alcohol (4) | 4 |
| Latex (as solids) | 11 |
| Solids concentration | 43% |
| pH | 8.4 |

(1) Hydrasuper, a product of J. M. Huber Company
(2) Aron F40, a product of Toa Gosei K.K.
(3) MS-3600, a product of Nippon Shokuhin Kako K.K.
(4) PVA-205, a product of Kuraray Co., Ltd.

Coated papers were prepared under the same conditions as in Example 1. The results of test are shown in Table 9.

TABLE 9

| Formulation | Latex | Ink receptivity | Gloss (%) | Printed gloss (%) | Brightness (%) | Dry pick strength | Wet pick strength |
|---|---|---|---|---|---|---|---|
| 2 | A | 4.7 | 56.3 | 81.8 | 76.4 | 4.0 | 3.8 |
| | H | 4.0 | 58.3 | 83.3 | 76.0 | 4.3 | 4.5 |
| | T | 4.7 | 58.0 | 82.3 | 76.4 | 3.5 | 3.8 |
| | (a) | 2.0 | 56.0 | 81.6 | 75.1 | 4.8 | 4.5 |
| 3 | A | 4.5 | 63.3 | 85.4 | 76.4 | 4.0 | 4.0 |
| | H | 3.8 | 64.7 | 87.0 | 76.4 | 4.5 | 4.3 |
| | T | 4.5 | 64.6 | 86.6 | 76.4 | 4.0 | 4.0 |
| | (a) | 2.5 | 58.1 | 85.1 | 76.0 | 4.5 | 4.0 |

It is clear from Table 9 that when the latices in accordance with this invention are used together with starch or polyvinyl alcohol, coated papers having superior ink receptivity are also obtained.

What we claim is:

1. A paper coating composition comprising:

(I) 100 parts by weight of a pigment, and (II) 1 to 30 parts by weight, as solids contents, of a latex comprising a copolymer derived from 20 to 50% by weight of an aliphatic conjugated diolefin, 0.5 to 4.8% by weight of an ethylenically unsaturated acid monomer, 0.5 to 4% by weight of an ethylenically unsaturated amine monomer, and 10 to 74% by weight of a mono-olefinically unsaturated monomer, selected from aromatic vinyl compounds, alkyl acrylates, alkyl methacrylates and ethylenic nitrile compounds, and an emulsifier in an amount of not more than 1% by weight based on the copolymer, said latex having a gel point within a pH range of 3.5 to 8.5 and being gellable during the drying of a paper coated with said composition, said composition having a higher pH than the gel point of the latex.

2. The paper coating composition of claim 1 wherein the latex (II) is obtained by emulsion-polymerizing the aliphatic conjugated diolefin, ethylenically unsaturated acid monomer and mono-olefinically unsaturated monomer, adjusting the pH of the system to at least 7 after the reaction, then adding the ethylenically unsaturated amine monomer alone or together with the aliphatic conjugated diolefin and mono-olefinically unsaturated monomer, and continuing the polymerization until it is completed.

3. The paper composition of claim 1 wherein at least 50% by weight of the pigment (I) consists of kaolinite clay.

4. A mineral-coated paper product comprising a paper sheet carrying on its surface a dried deposit of the coating composition of claim 1.

5. The paper coating composition of claim 1 further comprising a hydrophilic monomer selected from the group consisting of β-hydroxyethyl acrylate, β-hydroxy-propyl acrylate, β-hydroxyethyl acrylate, acrylamide, methacrylamide, N-methylol acrylamide, diacetone acrylamide, glycidyl acrylate, glycidyl methacrylate, acrolein, and allyl alcohol in combination with said mono-olefinically unsaturated monomer.

6. The paper coating composition of claim 1 wherein said mono-olefinically unsaturated amine monomer is selected from (a) monomers expressed by the general formula

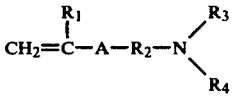

wherein $R_1$ represents hydrogen or methyl, $R_2$ represents alkylene of 2 to 10 carbon atoms, $R_3$ and $R_4$ represent hydrogen or alkyl of 2 to 12 carbon atoms, and A represents

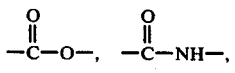

or —O—; and (b) vinylpyridines.

7. The paper coating composition of claim 1 additionally containing starch or polyvinyl alcohol.

8. A mineral-coated paper product comprising a paper sheet carrying on its surface a dried deposit of the coating composition of claim 2.

9. A mineral-coated paper product comprising a paper sheet carrying on its surface a dried deposit of the coating composition of claim 3.

10. The composition of claim 5 wherein the amine monomer is a compound of the formula:

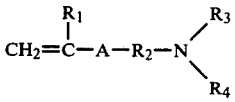

wherein $R_1$ is a hydrogen or methyl; $R_2$ is alkylene of 2 to 10 carbon atoms, $R_3$ and $R_4$ are independently of each other hydrogen or alkyl of 2 to 12 carbon atoms, and A is

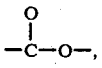

or —O—.

11. The composition of any one of claims 1 and 10 wherein the amount of the acid monomer is 0.4 to 4.0% by weight and the amount of the amine monomer is 0.5% to 4.0% by weight.

* * * * *

UNITED STATES PATENT AND TRADEMARK OFFICE

CERTIFICATE OF CORRECTION

PATENT NO. : 4,278,583

DATED : July 14, 1981

INVENTOR(S) : Masayoshi Sekiya

It is certified that error appears in the above—identified patent and that said Letters Patent is hereby corrected as shown below:

Claim 1, line 6, change "4.8%" to -- 4.0% --

Claim 10 lines 12-14 should read:

$$-\overset{\overset{\displaystyle O}{\|}}{C}-O-$$

Signed and Sealed this

*Twenty-ninth* Day of *September 1981*

[SEAL]

*Attest:*

GERALD J. MOSSINGHOFF

*Attesting Officer*

*Commissioner of Patents and Trademarks*